US006234849B1

(12) United States Patent
Blanche

(10) Patent No.: US 6,234,849 B1
(45) Date of Patent: May 22, 2001

(54) BATTERY TERMINAL CONNECTOR

(75) Inventor: Stephen A. Blanche, Warwick, RI (US)

(73) Assignee: ETCO Incorporated, Warwick, RI (US)

( * ) Notice: Subject to any disclaimer, the term of this patent is extended or adjusted under 35 U.S.C. 154(b) by 0 days.

(21) Appl. No.: 09/324,189

(22) Filed: Jun. 2, 1999

(51) Int. Cl.[7] ..... H01R 4/42

(52) U.S. Cl. ..... 439/764; 439/756

(58) Field of Search ..... 439/764, 762, 439/763, 759, 522, 770, 772, 754, 756

(56) References Cited

U.S. PATENT DOCUMENTS

| | | | | |
|---|---|---|---|---|
| 1,937,612 | * | 12/1933 | Walde | 439/756 |
| 2,078,846 | * | 4/1937 | Goulding et al. | 439/756 |
| 2,305,503 | * | 12/1942 | Tenney | 439/756 |
| 3,739,322 | * | 6/1973 | Haegert | 439/756 |
| 6,053,779 | * | 4/2000 | Liang | 439/756 |

* cited by examiner

*Primary Examiner*—Brian Sircus
*Assistant Examiner*—J. F. Duverne

(57) ABSTRACT

An electrical connector to post-type batteries in which the electrical cable or the like is selectively settably gripped using jaw elements movable toward or away from each other.

15 Claims, 2 Drawing Sheets

BATTERY TERMINAL CONNECTOR

FIELD

This invention relates to battery electrical connectors, and more particularly to such connectors useful for example in conjunction with so-called automobile batteries.

BACKGROUND

Such connectors known in the prior art include devices identical in their post and post-clamp portions with the preferred embodiment disclosed herein; however such prior art devices include wire-connecting portions for making a conventional crimping relationship rather than jawed selective wire-clamp portions; the three portions are in the same special relationship with one another as disclosed in the preferred embodiment herein, and formed like the latter from an integral biscuit-like (except for peripheral shape) flat cutout from tin-plated Alloy 260 cartridge brass sheet 0.050 inches thick.

SUMMARY

It is my conception that such an electrical connector more desirably includes integrally with its post portion a wire-clamp portion easily selectively connected mounted on a wire bundle by simple tightening of an integral clamp wall therearound.

In most preferred embodiments, the wire-clamp portion includes a pair of facing jaw surfaces, the jaws being hingedly connected through a bendable (about a longitudinal axis) wire-holding portion; each jaw includes along free edges flanges perpendicularly therefrom in directions away from the other jaw; a bolt bead cooperates with inner surfaces of the flanges of one jaw to prevent bolt turning; the jaw surface of the last-mentioned jaw lies in a plane parallel with that of symmetry of the post portion; and the jaw surface of the other jaw is the locus of lines parallel to that longitudinal axis and defining a plane at an angle of 30 degrees to that of the other before tightening through holes in the jaws of a bolt including the bolt head.

PREFERRED EMBODIMENT

My specification of a preferred embodiment follows.

DRAWINGS

DESCRIPTION

Figure 1:
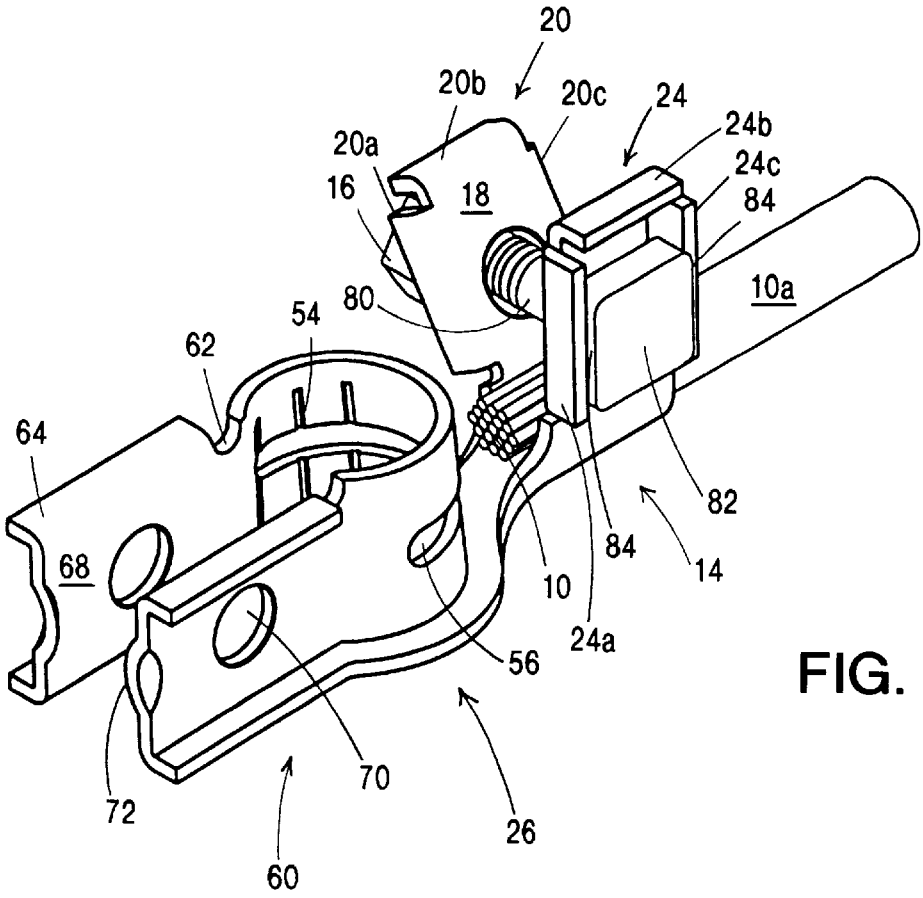
FIG. 1 is an isometric view of the presently preferred embodiment, shown with its wire bundle.
Figure 7:
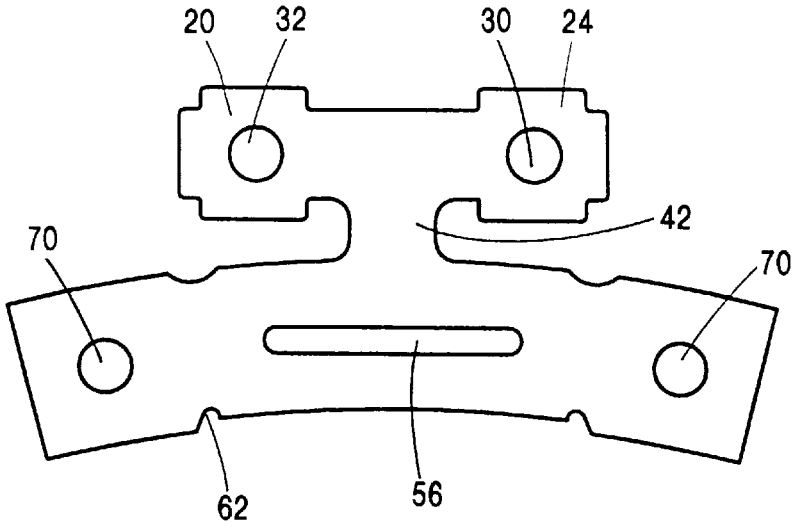
FIG. 7 is a plan view of the blank for forming into the preferred embodiment.
Figure 2:
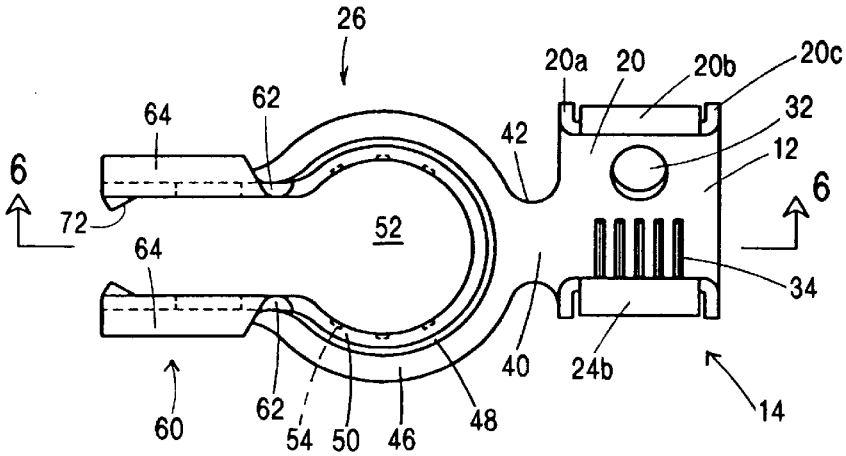
FIG. 2 is a plan view of said embodiment.
Figure 3:
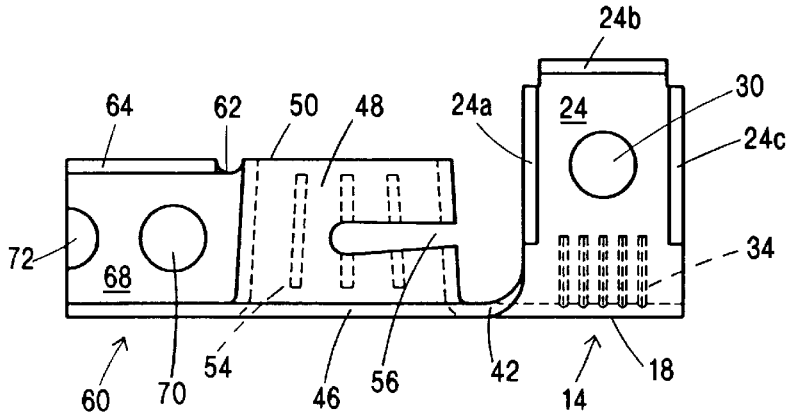
FIG. 3 is a side elevation thereof.
Figure 6:
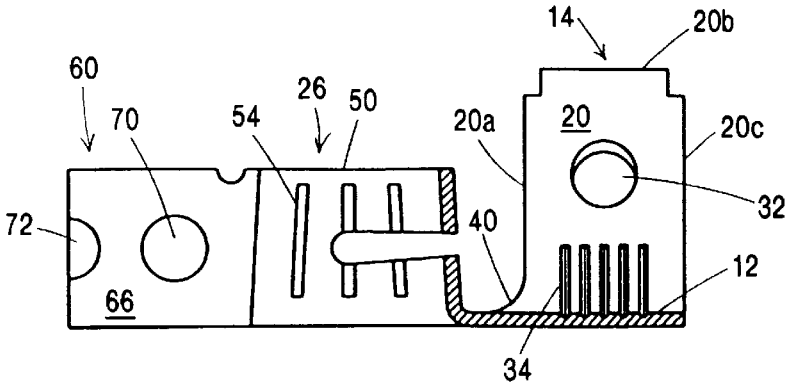
FIG. 6 is a sectional view at 6—6 of FIG. 2.
Figure 4:
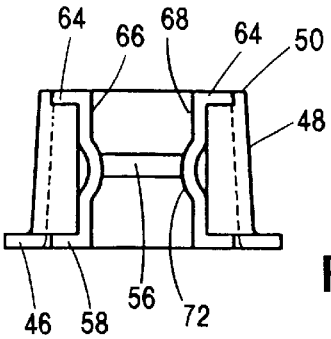
FIGS. 4 and 5 are end elevation views thereof.

There is shown in FIG. 1 at 10 a conventional bundle of wires, covered as is conventional by separate wires insulation (not shown) and by insulation sleeve 10*a*.

Figure 5:
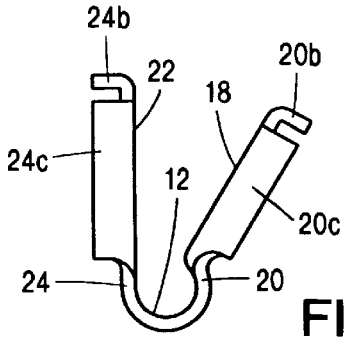

The wire bundle 10 is shown in FIG. 1 lying on the lower inside surface 12 (FIG. 5) of the bendable, cylindrical wire-gripping wire jaw portion, indicated generally at 14. When nut 16 is further tightened, to bend portion 14 to bring the inner surface 18 of jaw element (indicated generally at) 20 into general parallelism with both the inner surface 22 of jaw element (indicated generally at) 24 and the plane of symmetry containing the centerline of post portion indicated generally at 26, the insulated wire bundle 10 is clamped against generally semicylindrical portion 12 for about 180 degrees.

Jaw element 20 carries integrally three flanges 20*a*, 20*b*, and 20*c*. Jaw element 24 carries integrally three flanges 24*a*, 24*b*, and 24*c*. These flanges extend perpendicularly outwardly of flat central jaw surfaces 18 and 22, from respectively locations longitudinally closest, intermediately close to, and farthest from the battery post portion 26. Round hole 30 extends through the thickness of jaw element 24. Round hole 32 extends through the thickness of jaw element 20. Grooves 34, parallel and triangular in cross-section in the plane of symmetry already mentioned, with apices in that plane pointing outwardly of the portion 14, extend transversely and circumferentially about half way around inner surface 12.

Neck 40, defined on opposed transverse sides by opposed semicylindrical cut sheet portions 42 extending each almost 180 degrees, integrally joins wire-clamp portion 14 and battery post portion 26.

Portion 26 is provided with flange 46 integral with neck 40 from which flange rises frustoconical wall 48 with upper edge 50. Extending intermediately of the height of wall 48 within concentric frustoconical hole 52 therethrough from just about the bottom of said hole to just below the top of said hole are a multiplicity of blind (i.e., bottomed, not extending through the wall to its outer surface any more than to its top or bottom) slots 54, each providing spaced sharp 90 degree edges. Each slot 54 has a length extending with its centerline generally corresponding with a line extending from the imaginary apex of the frustocone as extended along the imaginary plane of symmetry passing through that apex and the centerline of the particular slot 54. Extending longitudinally into portion 26 about a plane parallel with those of edge 50 and flange 46 and about half way therebetween is slot 56, extending circumferentially about 180 degrees and narrowing in height in the direction of its opening.

Flange 46 extends integrally to provide also a flange 58 for the post-clamp portion, indicated generally at 60. Notches 62 are opposed to facilitate provision of flanges 64 extending integrally, perpendicularly transversely oppositely outwardly of portion 60. Jaw elements 66 and 68 are integral with wall 48 and flanges 46 and 58. Holes 70 provide for nut- and bolt-tightening down toward each other of jaw elements 66 and 68, to secure clamping at post portion 26. Protrusions 72 provide mutually engaging limits on movement together of the jaw elements.

Operation

Wire bundle 10, from the end wires of which insulation has been stripped, is placed as shown in FIG. 1, and then nut 16 tightened on bolt 80 with square head 82 prevented from turning by abutting head surfaces 84; so that tightening moves surface 18 into general parallelism with surface 24, conductively gripping in portion 12 the bundle 10. The jaw elements 20 and 24 in respectively their surfaces 18 and 22 are selectively reversibly movable relatively toward and away from each other and selectably settable relative to each other at positions to which they have been moved. The sharp edges, pointing into the wires, of elements 34, improve conductive contact.

Hole 52 of portion 26 is lowered into contact with a battery post of configuration to fit matingly. A nut is then tightened on a bolt (neither shown) through holes 70 of portion 60 to draw together jaw elements 66, 68 to provide tightly clamping mechanical and electrical contact between the battery post and the inner surface of wall 48, contact aided by sharp-edged blind slots 54, which tend to dig in. Undue tightening is restricted by protrusions 72.

The new invention, with its easy means of connecting to or disconnecting from wire-clamping portion and wires, puts these operations with much easier facility in the hands of actual users, such as car owners.

Manufacture

First, I make a flat sheet metal "cookie" with perimeter to provide the ultimate shape of a connector, with cut-through holes 30, 32, and 70 and slot 56, and indentations 34, 54, and 72. The blank thus provided is then shaped into the configuration of the preferred connector embodiment. The slot 56 aids in forming; in the blanks its upper and lower portions from the half circles are parallel, but they come to slope toward each other centrally in forming the connector.

Other Embodiments

Other embodiments will occur to those in the art.

I claim:

1. An electrical connector comprising an integral post-engagement portion, said post-engagement portion being recessedly configured to accept electrically and mechanically a battery post, an integral wire-engagement portion, an integral wire-clamp portion, said wire-clamp portion including a pair of integral jaw elements selectively reversibly movable relative to each other and selectively operable to settably clamp an electrical conduit, and an integral post-clamp portion, said post-engagement portion, said wire-clamp portion, and said post-clamp portion are separate from each other, said post-engagement portion being intermediate of, integral with, and adjacent to each of said wire-engagement portion and said post-clamp portion, and said wire-engagement portion being intermediate of, adjacent to, and integral with each of said post-engagement portion and said wire-clamp portion, each said portion being of conductive metal sheet.

2. The connector of claim 1 in which said wire-clamp portion includes a bendable portion between and integral with said jaw elements.

3. The connector of claim 2 in which said bendable portion comprises coaxial cylindrical surfaces.

4. The connector of claim 3 in which said cylindrical surfaces extend over an arc of 180 degrees.

5. The connector of claim 2 in which said bendable portion is integral with said post portion.

6. The connector of claim 5 in which said bendable portion and said post portion are joined by a narrow neck therebetween.

7. The connector of claim 1 in which each said jaw element includes a flat central portion and flanges bent out therefrom toward the other said jaw element.

8. The connector of claim 7 in which each said jaw element includes three said flanges.

9. The connector of claim 8 in which each said flange extends perpendicularly away from said flat central portion.

10. The connector of claim 1 in which said wire-clamp portion includes means for selectively movably toward and away from each other and settably relatively to each other and selectively settably positioning relative to each other said jaw elements.

11. The connector of claim 10 in which said means consists of a bolt and a cooperating nut.

12. The connector of claim 11 in which one of said nut and the head of said bolt cooperates with a said flange to prevent turning when the other thereof is rotated.

13. The connector of claim 1 in which a post-accepting hole in said post portion includes inner sharp edges.

14. The connector of claim 13 in which said sharp edges are carried by blind slots extending generally axially of said hole.

15. The connector of claim 2 in which said bendable portion includes on an inner surface circumferentially extending sharp edges.

* * * * *